US005454981A

United States Patent [19]

Sherry et al.

[11] Patent Number: 5,454,981

[45] Date of Patent: Oct. 3, 1995

[54] CLEANING COMPOSITIONS THICKENED WITH SUCCINIMIDE COMPOUNDS

[75] Inventors: Alan E. Sherry; Daniel S. Connor, both of Cincinnati, Ohio

[73] Assignee: The Procter & Gamble Company, Cincinnati, Ohio

[21] Appl. No.: 209,176

[22] Filed: Mar. 10, 1994

[51] Int. Cl.[6] ..... C11D 3/28; C11D 1/12; C11D 7/08

[52] U.S. Cl. ..... 252/542; 252/550; 252/142; 252/173; 252/DIG. 14; 134/3; 134/42

[58] Field of Search ..... 252/542, 544, 252/524, 548, 142, 173, 550, DIG. 14; 134/3, 42; 548/547

[56] References Cited

U.S. PATENT DOCUMENTS

| | | | |
|---|---|---|---|
| 3,879,306 | 4/1975 | Kablaoui et al. | 252/51.5 A |
| 4,420,407 | 12/1983 | Sung | 252/33.4 |
| 4,505,832 | 3/1985 | Whiteman | 252/42.1 |
| 5,108,643 | 4/1992 | Loth et al. | 252/174.11 |

FOREIGN PATENT DOCUMENTS

| | | | |
|---|---|---|---|
| 2230021 | 10/1990 | United Kingdom | C11D 1/72 |

OTHER PUBLICATIONS

Aliev et al, "Synthesis of N–Substituted Alkenylsuccinimides" Baku, USSR *Azerb. Khim. Zh.* (3), 61–3 (1978).

*Primary Examiner*—Paul Lieberman
*Assistant Examiner*—Lorna M. Douyon
*Attorney, Agent, or Firm*—Jerry J. Yetter; Kim William Zerby; Jacobus C. Rasser

[57] ABSTRACT

Thickened liquid detergent compositions are prepared using N-hydroxyalkyl succinimide compounds as the thickening agent. Stable compositions at acidic pH's are used to remove lime scale from bathroom tile surfaces. Thus, octyl-N-(2-hydroxyethyl)-succinimide is prepared by the reaction of N-octylsuccinic anhydride and monoethanolamine and combined with magnesium $C_{12}$ alkyl sulfate and citric acid at a pH around 2 in a water carrier and used to remove lime scale from environmental surfaces.

7 Claims, No Drawings

CLEANING COMPOSITIONS THICKENED WITH SUCCINIMIDE COMPOUNDS

TECHNICAL FIELD

This invention relates to thickened liquid detergent compositions. N-hydroxyalkyl succinimide compounds are used to provide thickened liquids which have substantially Newtonian flow properties. The compositions are especially useful at low pH's to remove lime scale from environmental surfaces in bathrooms and kitchens.

BACKGROUND OF THE INVENTION

Formulators often wish to provide liquid detergent compositions in thickened form. Aesthetically, thickness can connote richness or strength of the compositions. In some instances, the formulator may wish to suspend solid materials such as abrasives or particulate bleaches in the liquid compositions. A wide variety of thickeners have been developed for such uses.

Liquid cleaning compositions which are especially designed for direct application to hard surfaces are often thickened to provide ease-of-use on vertical surfaces such as bathroom shower walls, toilets and bathtub walls. The cleaning of such environmental surfaces can be problematic, inasmuch as calcareous deposits, commonly known as "lime scale", are often formed thereon by water hardness. In order to provide good lime scale removal, it is highly preferred to formulate cleaning compositions at acidic pH's, often at pH's in the range of 2–3.

Unfortunately, it can be difficult to thicken liquid cleaning compositions at acidic pH's. Conventional thickening polymers often do not exhibit Newtonian flow properties under such circumstances and are not optimal for such use. Monomeric thickeners which may exhibit Newtonian flow properties at higher pH's do not function well in the acid range.

It has now been determined that certain N-hydroxyalkyl succinimides provide thickened aqueous cleaning compositions. These compositions are stable and exhibit substantially Newtonian flow properties even at low pH. These compositions can be employed in any circumstance where thickened liquid cleaning compositions are desirable, but can be formulated to be especially useful for removing lime scale from household environmental surfaces. The succinimide compounds used herein are also substantially less expensive than other thickeners known in the art.

BACKGROUND ART

Baku, Azerb, Khim Zh. (3), 61–3 (1978) and U.S. Pat. Nos. 4,505,832, 4,420,407 and 3,879,306 all relate to various uses of succinimide compounds. Polyether succinimides are reported in GB 2230021 A—Oct. 10, 1990 (GB 89-7835 890407; CA 114(22) 209600n).

SUMMARY OF THE INVENTION

The present invention encompasses thickened, aqueous compositions, comprising:

(a) an anionic surfactant (preferably in magnesium salt form);

(b) an N-hydroxyalkyl succinimide of the formula:

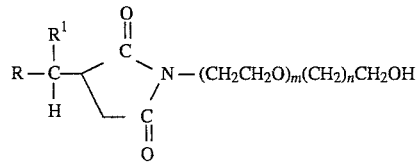

(I)

wherein R is about $C_2$–$C_{16}$ hydrocarbyl, $R^1$ is hydrogen or about $C_1$ to about $C_{16}$ hydrocarbyl, the sum of R and $R^1$ being most preferably $C_8$–$C_{12}$ hydrocarbyl, m is 0 to about 8 and n is 0 to about 7; and (c) water.

Preferred compositions herein are those wherein the anionic surfactant is either an alkyl sulfate (AS) or alkyl ethoxy sulfate (AES), most preferably magnesium $C_{12}$–$C_{14}$ alkyl sulfate. Most preferably, the N-hydroxyalkyl succinimide is a hydroxyethyl succinimide, i.e., m=0, n=1, especially wherein R is $C_6$–$C_{12}$ alkyl or alkenyl (including branched or linear) and $R^1$ is hydrogen. The novel compound wherein R is $C_7H_{15}$, $R^1$ is H and n=1 is preferred herein.

Highly preferred compositions herein are formulated at an acidic pH, especially at a pH of about 3, or below.

The invention also encompasses a method for preparing a thickened aqueous solution at a pH of about 3, or below, comprising admixing in water a magnesium anionic surfactant and an N-hydroxyalkyl succinate, as noted above.

In its most preferred embodiment, the invention encompasses thickened, aqueous cleaning compositions especially adapted for removing lime scale from environmental surfaces, comprising:

(a) an anionic surfactant;

(b) an N-hydroxyalkyl succinimide thickener of the above-noted formula (I);

(c) an acidifying agent; and (d) an aqueous carrier, said composition being formulated at an acidic pH.

In such compositions, the anionic surfactant is preferably an alkyl sulfate, and is most preferably a magnesium alkyl sulfate.

In such compositions, the N-hydroxyalkyl succinimide is preferably a hydroxyethyl succinimide.

The acidifying agent used in such compositions is preferably a member selected from the group consisting of citric acid (most preferred), oxydisuccinic acid, maleic acid, malonic acid, and mixtures thereof. Such compositions are most preferably formulated at a pH of about 3, or below, most preferably from about 2.0 to about 2.7.

The invention also encompasses a method for removing lime scale from hard surfaces such as bathroom tiles, bathtubs, bath showers, toilets, and the like, by contacting said surfaces with a composition according to this invention, preferably with agitation.

All percentages, ratios and proportions herein are by weight, unless otherwise specified. All documents cited are, in relevant part, incorporated herein by reference.

DETAILED DESCRIPTION OF THE INVENTION

Thickener—The thickeners of formula (I), hereinabove are easily prepared by reacting a succinic anhydride material with a monoalkanolamine. The reaction can be conducted with succinic anhydride or a hydrocarbyl-substituted succinic anhydride (preferred) wherein the hydrocarbyl substituent is preferably in the range from about $C_6$–$C_{14}$, most preferably about $C_8$ alkyl or alkenyl. The alkanolamine can be, for example, monomethanolamine, monoethanolamine (preferred) monopropanolamine, monobutanolamine, and the like, as well as oxygen-containing amines such as $H_2N[(CH_2)_2O(CH_2)_2]_xOH$, wherein x is 1, or greater, preferably from 1 to about 5. Compounds of formula (I) wherein m and n are both zero can be prepared by reacting formaldehyde with an N-H succinimide.

While not intending to be limited by theory, it is speculated that the succinimide thickener is protonated in the acidic compositions herein and forms ion pairs with the anionic surfactants, particularly with the alkyl sulfate surfactants. Spherical micelles become elongated, and the viscosity of the solution increases. Divalent cations, such as magnesium ions (preferred), if present, further assist the packing of the surfactant, resulting in a greater nonionic-like character, and the result is a further increase in the overall product viscosity.

Various types of surfactants can be employed herein. Based on the above speculative model, it is seen that any predominantly straight chain, anionic surfactant, whose hydrophobic substituent contains at least about 10–12 carbon atoms, can be used in the present compositions. Branching can be anticipated to weaken the electrostatic interactions responsible for the self-thickening process. Zwitterionic substrates and nonionics that are protonated at low pH can be employed in the system, such as amine oxides, betaines, sulfobetaines, and amides can be employed.

The divalent cations, such as magnesium, calcium (less preferred) and the like can be introduced into the system either as water-soluble inorganic salts such as magnesium chloride, magnesium chloride, magnesium sulfate, and the like, or, more preferably, as the counterion to the anionic surfactant. Thus, it is preferred to separately prepare magnesium salts of the $C_{12}$–$C_{14}$ linear alkyl sulfate surfactants and to employ such magnesium salts in the present process. As will be appreciated by the formulator, this minimizes the introduction of extraneous ionic materials into the compositions, which is advantageous since, as with most thickened systems, too high an ionic strength can decrease viscosity.

Surprisingly, the compositions herein can be formulated at acidic pH's where it is generally believed the hydrolysis of dilute solutions of alkyl sulfate (AS) surfactants normally occurs (ca. pH 2.7). While again not intending to be limited by theory, it may be speculated that the packing of the AS and succinimides and the thickening of the present composition somehow "protect" the AS from acid attack, perhaps by steric effects. Whatever the reason, the preferred compositions herein are stable for at least four months' storage at room temperature.

Depending on the viscosity desired, the N-hydroxyalkyl succinimides are typically employed in the present compositions at concentrations from about 0.5% to about 10%, preferably from about 0.75% to about 4%, by weight. The preferred compositions herein will typically employ the thickener and anionic surfactant at a weight ratio of thickener:surfactant in the range from about 1:7 to about 1:1. This can be varied according to the desired viscosity of final product.

The mole ratio of divalent cation to anionic surfactant is typically an amount sufficient to provide ionic neutrality of the surfactant. For example, two moles of alkyl sulfate surfactant are used per one mole of magnesium cation.

When using the sodium form of the anionic surfactant, the product must be formulated at about a pH 3, or higher to achieve desirable viscosities. (Conversely, when Mg is present, lower pH's can be achieved).

Using the foregoing information, compositions of the present type can be readily prepared having viscosities in the range of at least about 75 centipoise (cP) to about 1500 cP. For use in bathroom cleaners, and the like, it is preferred that the compositions be in the range from about 75 cP to about 200 cP.

The following describes the synthesis of a preferred $C_8$ succinimide thickener for use herein.

Preparation of n-octyl-N-(2-hydroxyethyl)-succinimide. n-Octylsuccinic anhydride, 466.4 g (2.2 mole) is melted in a 140° C. oil bath under a nitrogen sweep. Monoethanolamine, 134.2 g (2.2 mole) is dripped in (10 minutes) while cooling the reaction in a 15° C. $H_2O$ bath to control the exotherm. The bath temperature is raised to 160° C. Water is removed under a low vacuum with the bath temperature at 160° C. as the imide is formed. Temperature of the reaction increases until 150° C. is reached. After 240 minutes, the reaction is complete. GC analysis (based on relative area percent) shows the succinimide to be 96% pure.

The n-hexyl compound is prepared in like manner using n-hexylsuccinic anhydride.

Preparation of n-$C_{10}$ (N-$CH_2CH_2OCH_2CH_2OH$)—In a similar preparation, n-decenyl succinic anhydride (10.5 g; 0.1 mole) is reacted with 2-(2-aminoethoxy) ethanol (23.8 g; 0.1 mole) to provide the title compound. GC analysis indicates the reaction to be about 85% complete after 120 minutes in a 150° C. heating bath.

Surfactant. The compositions herein will comprise at least about 1%, typically from about 1% to about 15%, preferably from about 2% to about 7%, by weight of an anionic surfactant. Most preferred herein are the primary, secondary branched-chain and linear $C_{10}$–$C_{22}$ alkyl sulfates ("AS"), especially $C_{12}$–$C_{14}$ linear AS. While any alkali or alkaline earth salt can be used herein, it is preferred to use the magnesium salt of the anionic surfactant, especially $Mg(AS)_2$.

Non-limiting examples of other surfactants which optionally can be used herein at similar levels, especially in combination with the AS surfactants, include the conventional $C_{11}$–$C_{18}$ alkyl benzene sulfonates ("LAS"), the $C_{10}$–$C_{18}$ alkyl alkoxy sulfates ("$AE_xS$"; especially EO 1–5 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ sulfated alkyl polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{10}$–$C_{18}$ alkyl polyglycosides, $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. Other conventional useful surfactants are listed in standard texts. Incorporation of such additional surfactants enhances the removal of greasy/oily soils from the surfaces being cleansed by the present compositions.

Short-Chain Surfactants—Of particular interest herein for removing the so-called "soap scum" from hard surfaces, especially bathtubs and bath showers, is the sub-class of short-chain surfactants. These include compounds containing from 6 to 10 carbons and 2 to 10 ethoxylate groups per alkyl chain. Examples of short chain ethoxylates are $C_6E_3$, $C_8E_4$, $C_{10}E_6$, and the like. In general, short chain ethoxylates depress the viscosity of formulations. However, succinimide surfactants of the present type allow the incorporation of 0–2% short chain ethoxylate while maintaining an adequately thickened product.

Acidifying Agent. Various organic acid acidifying agents are preferably used to adjust the acid pH of the lime scale removal compositions herein, but fatty acids are preferably not used. Conventional inorganic acids such as HCl, $H_2SO_4$, and the like, tend to lessen the viscosity of the compositions and are less preferred than the organic acids. At pH's near 3.0, the organic acidifying agents which are useful herein may also provide some calcium ion chelation effects. The following are non-limiting examples of such materials. All such materials are preferably used in their free acid form.

Various polycarboxylate acidifying agents can be used herein. Included among the acidifying agents are a variety of categories of useful materials, including the ether polycarboxylic acids, including oxydisuccinic acid, as disclosed in Berg, U.S. Pat. No. 3,128,287, issued Apr. 7, 1964, and Lamberti et al, U.S. Pat. No. 3,635,830, issued Jan. 18, 1972. See also the acid forms of the "TMS/TDS" compounds of U.S. Pat. No. 4,663,071, issued to Bush et al, on May 5, 1987. Suitable ether polycarboxylic acids also include cyclic compounds, particularly alicyclic compounds, such as those described in U.S. Pat. Nos. 3,923,679; 3,835,163; 4,158,635; 4,120,874 and 4,102,903.

Other useful acidifying agents include the ether hydroxypolycarboxylic acids, copolymers of maleic anhydride with ethylene or vinyl methyl ether, 1, 3, 5-trihydroxy benzene-2, 4, 6-trisulphonic acid, and carboxymethyloxysuccinic acid, as well as polycarboxylic acids such as mellitic acid, succinic acid, oxydisuccinic acid, phthalic acid, polymaleic acid, benzene-1,3,5-tricarboxylic acid, benzene-1,2,4-tricarboxylic acid, carboxymethyloxysuccinic acid, and the like.

Citrate acidifying agents, e.g., citric acid (most preferred) is of particular importance herein due to its performance in the thickening milieu as well as its availability from renewable resources and biodegradability. Malic acid is also quite useful in the present compositions.

Also suitable in the compositions of the present invention are the 3,3-dicarboxy-4-oxa-1,6-hexanedioic acid and the related compounds disclosed in U.S. Pat. No. 4,566,984, Bush, issued Jan. 28, 1986. Other suitable polycarboxylic acids are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Other acidifying agents useful herein can be selected from the group consisting of amino carboxylic acids, amino phosphonic acids, polyfunctionally-substituted aromatic acids and mixtures thereof.

Amino carboxylic acids useful herein include the acid forms of the ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines.

Amino phosphonic acids suitable for use in the compositions of this invention include the ethylenediaminetetrakis(methylenephosphonic acids) as DEQUEST. Preferably, these amino phosphonic acids do not contain alkyl or alkenyl groups with more than about 6 carbon atoms.

Polyfunctionally-substituted aromatic acidifying agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable acidifying agent for use herein is ethylenediamine disuccinic acid ("HEDDS"), especially the [S,S] isomer as described in U.S. Pat. No. 4,704,233, Nov. 3, 1987, to Hartman and Perkins.

If utilized, these water-soluble acidifying agents will generally comprise from about 0.1% to about 15% by weight of the compositions herein. Mixtures of the acidifying agents may also be used, if desired. More preferably, the acidifying agents will comprise from about 0.1% to about 10% by weight of compositions intended for removing lime scale. As noted, citric acid is most preferred for this use.

Fluid Carrier—Water or, less preferred, water-ethanol or water-isopropanol, is used as the fluid carrier for the present compositions. Typically, water will comprise from about 50% to about 95% by weight of the compositions.

Product pH—The pH of the preferred lime scale removal compositions herein can be adjusted using the acidifying agents noted above. In a preferred mode, the pH is in the range of about 3.0, and below. Higher pH's can be employed in products intended for other uses. pH can be measured on freshly made product, without dilution.

Optional Ingredients—The compositions of the present invention can also comprise from about 0.1% to about 30% by weight of various optional detersive and/or aesthetic ingredients, according to the desires of the formulator. Perfumes, opacifying agents such as titanium dioxide flakes, conventional abrasives such as powdered calcium carbonate, silica, pumice, and the like, bleaches such as peroxides and hypochlorite, hypobromite and monopersulfate, and the like, all of which are typical ingredients for various hard surface cleaners, can optionally be employed herein, according to the desires of the formulator.

Viscosity Measurements—The viscosity is routinely measured using undiluted, freshly-made compositions at 20° C. . The measurements are made in centipoise (cP) units using a Brookfield viscometer with #2 spindle operating at 60 rpm.

The following Examples further illustrate the lime scale removal compositions of this invention, but are not intended to be limiting thereof.

EXAMPLE I

| Ingredient | % (wt.) |
|---|---|
| $C_{12}$ Alkyl Sulfate, Mg Salt | 5.0 |
| Citric Acid | 6.0 |
| $C_8$ Hydroxyethyl Succinimide* | 1.25 |
| Perfume | 0.4 |
| Water | Balance |
| Product pH | 2.1 |

*Prepared as disclosed above.

The composition of Example I is prepared by admixing the indicated ingredients. The initial viscosity of the composition is 130 cP. In-use, the composition is applied directly to lime scale on hard surfaces, with hand-rubbing.

EXAMPLE II

| Ingredient | % (wt.) |
|---|---|
| $C_{12}$ Alkyl Sulfate, Mg Salt | 5.0 |
| Citric Acid | 6.0 |
| $C_8$ Hydroxyethyl Succinimide* | 1.4 |
| Perfume | 0.4 |
| Water | Balance |
| Product pH | 2.1 |

*Prepared as disclosed above.

The composition of Example II is prepared by admixing the indicated ingredients. The initial viscosity of the composition is 175 cP.

Lime Scale Tests

Compositions of the type disclosed in Examples I and II are tested against control compositions for lime scale performance. The tests are conducted by the following soaking procedure.

Approximately 100 g of the test solution is weighed in a 200 cc jar. A marble block (ca. 2×2×0.5 $cm^3$)(weight:X grams) is immersed in the test solution for ca. 30 minutes. The immersion time can be reduced or extended depending on the data needed. Marble blocks of a certain test series (to be compared) should have all about the same weight (±5% variation). At the end of the test period, the marble block is rinsed with soft water, left to dry in the air and weighed again (Y grams). The weight difference before and after immersion (X-Y) represents the total amount of $CaCO_3$ decomposed into water and $CO_2$:

$CaCO_3$ (lime scale) solubilization capacity=(X-Y) grams.

The relative $CaCO_3$ solubilization capacities are then indexed versus a high commercial standard (index 100) to obtain an "ease of lime scale removal index".

In the following tests, the Control Composition comprises: water and 7.0% $C_{12}$ alkyl sulfate, Na salt; 7.0% citric acid; 1.9% $C_{9-11}$ ethoxylate (2.25); 1.75% $C_8$ ethoxylate (4); 1.9% triethanolamine; and 0.4% perfume. Product pH is 3.4. Viscosity is 175 cP. The performance of Control Composition A is arbitrarily assigned a Limescale Index of 100.

| | Test Results | | |
|---|---|---|---|
| | Control | Example I* | Example II* |
| Surfactant Level | 10.55% | 6.25% | 6.40% |
| Limescale Index | 100 | 229 | 216 |

*Compositions of Examples I and II, above.

The following Examples further illustrate the practice of the invention in other cleaning compositions.

EXAMPLE III

An abrasive thickened liquid composition especially useful for cleaning bathtubs and shower tiles is as follows:

| Ingredient | % (wt.) |
|---|---|
| $C_{12}AS$, Mg Salt | 5.0 |
| $C_{12-14}$ $AE_3S$, Na Salt | 1.5 |
| $C_{8-10}$ Hydroxypropyl Succinimide | 1.45 |

-continued

| Ingredient | % (wt.) |
|---|---|
| Oxydisuccinic Acid | 0.5 |
| Citric Acid | 5.5 |
| Calcium Carbonate Abrasive (15–25 micrometer) | 15.0 |
| Water | Balance |
| Product pH | Adjust to 2.5 |

EXAMPLE IV

A composition comprising a short-chain surfactant which provides additional benefits with respect to the removal of soap scum from shower walls, bathtubs, and the like, is as follows.

| Ingredient | % (wt.) |
|---|---|
| $C_{12}AS$, Mg Salt | 6.0 |
| $C_8E_4$ Nonionic | 1.0 |
| Citric Acid | 6.0 |
| Water | Balance |

The product pH is about 2.2 and the viscosity is 150 cP at 70° F. (21° C.).

EXAMPLE V

A thickened composition containing an unsaturated succinimide is as follows.

| Ingredient | % (wt.) |
|---|---|
| $C_{12}AS$, Mg | 7.0 |
| Citric Acid | 7.0 |
| 2-Octenyl N-Hydroxyethyl Succinimide | 2.0 |
| Perfume | 0.4 |
| Water | Balance |

The product pH is ca. 2.1, viscosity 120 cP at 70° F. (21° C.).

In compositions according to the foregoing Examples, the sodium salt of the anionic surfactant may be employed without magnesium. The product pH should be around 3.0 or higher and should be adjusted with base such as triethanolamine, ammonium hydroxide, or the like. The same range of product viscosities can be achieved. The following illustrates this point:

EXAMPLE VI

Compositions A, B and C each comprising 7.0% sodium coconutalkyl sulfate, 7.0% citric acid 0.4% perfume and water are prepared. Compositions A, B and C comprise 2.50%, 2.75% and 3.00%, by weight of $C_{10}$ N-hydroxyethyl succinimide thickener, respectively. Triethanolamine is added to each composition to vary the pH over the range of about 2.2 to about 3.4. The viscosity varies as shown below.

| % TEA Added | Composition A | Composition B | Composition C |
|---|---|---|---|
| 0.75 | 10 | 17 | 30 |
| 1.0 | 13 | 23 | 61 |
| 1.25 | 13 | — | 123 |
| 1.50 | 17 | 46 | 237 |
| 1.75 | — | 78 | 443 |
| 2.00 | 27 | 128 | 635 |
| 2.25 | 37 | 238 | 1105 |
| 2.50 | 54 | 383 | — |
| 2.75 | 90 | 678 | — |
| 3.00 | 128 | 853 | — |

What is claimed is:

1. A thickened, aqueous cleaning composition especially adapted for removing lime scale from environmental surfaces, comprising:

(a) from about 1% to about 15%, by weight, of an anionic surfactant;

(b) as thickener, from about 0.5% to about 10%, by weight, of an N-hydroxyalkyl succinimide of the formula

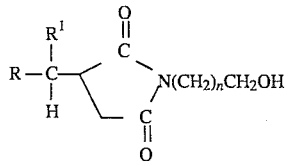

wherein R is about $C_3$ to about $C_{16}$ hydrocarbyl, $R^1$ is hydrogen or about $C_3$ to about $C_{16}$ hydrocarbyl and n is 0 to about 7; and (c) an acidifying agent; said composition being formulated at a pH of about 3 or below.

2. A composition according to claim 1 wherein the anionic surfactant is in its magnesium salt form.

3. A composition according to claim 1 wherein the anionic surfactant is magnesium alkyl sulfate.

4. A composition according to claim 1 wherein the N-hydroxyalkyl succinimide is a hydroxyethyl succinimide.

5. A composition according to claim 1 wherein the acidifying agent is citric acid.

6. A composition according to claim 5 which is formulated at a pH of from about 2.0 to about 2.7.

7. A method for removing lime scale from hard surfaces by contacting said surfaces with a composition according to claim 1.

* * * * *